United States Patent [19]

du Temple de Rougemont

[11] 4,188,518

[45] Feb. 12, 1980

[54] MINIATURE ELECTRICAL PUSH BUTTON CONTACTOR

[75] Inventor: Christian du Temple de Rougemont, Paris, France

[73] Assignee: Isostat, Cucq, France

[21] Appl. No.: 965,751

[22] Filed: Dec. 4, 1978

Related U.S. Application Data

[63] Continuation of Ser. No. 804,396, Jun. 7, 1977, abandoned.

[30] Foreign Application Priority Data

Jun. 16, 1976 [FR] France ..... 76 18206

[51] Int. Cl.[2] ..... H01H 3/12; H01H 1/18

[52] U.S. Cl. ..... 200/159 R; 200/241

[58] Field of Search ..... 200/159 R, 159 A, 159 B, 200/239, 241, 242, 160, 76

[56] References Cited

U.S. PATENT DOCUMENTS

| | | | |
|---|---|---|---|
| 1,316,372 | 9/1919 | Liebreich | 200/159 R |
| 2,384,412 | 9/1945 | Woods | 200/76 |
| 2,930,859 | 3/1960 | Nolden et al. | 200/159 R X |
| 3,175,066 | 3/1965 | Fiddler | 200/159 A |
| 3,223,813 | 12/1965 | Lewandowski | 200/159 R |
| 3,249,726 | 5/1966 | Long | 200/159 R |
| 3,949,181 | 4/1976 | Kempf | 200/159 R |
| 3,959,611 | 5/1976 | Greene et al. | 200/159 B X |
| 4,004,121 | 1/1977 | Twyford | 200/159 R X |

FOREIGN PATENT DOCUMENTS

| | | |
|---|---|---|
| 300535 | 11/1928 | United Kingdom . |
| 1421079 | 1/1976 | United Kingdom . |
| 1460021 | 12/1976 | United Kingdom . |

*Primary Examiner*—Steven M. Pollard

*Attorney, Agent, or Firm*—Schwartz, Jeffery, Schwaab, Mack, Blumenthal & Koch

[57] ABSTRACT

The invention concerns a miniature electrical push button contactor including a base carrying fixed contacts and having a cap which is formed integrally with the push button and which has a movable contact in the form of a thin disc which effects a wiping action on the fixed contacts. The invention also concerns electronic calculators fitted with contactors as aforesaid.

8 Claims, 6 Drawing Figures

MINIATURE ELECTRICAL PUSH BUTTON CONTACTOR

This is a continuation of application Ser. No. 804,396, filed June 7, 1977, now abandoned.

The present invention relates to a miniature electrical push button contactor and more particularly to a contactor having an inoperative condition in which the circuit or circuits controlled by the contactor are open, and an operative condition in which the push button is depressed and the circuit or circuits are closed.

The invention is applicable, for example, to electronic apparatus such as miniature electronic calculators in which such contactors are grouped to form a keyboard.

Previously known contactors of this type have comprised a relatively large number of parts, and, moreover, they often have a relatively short life as a result of dirtying of the contacts.

An object of the present invention is to obviate or mitigate these disadvantages by providing a contactor which comprises a relatively small number of parts which can be assembled easily and economically on automatic machines, the contacts of which are self-cleaning, and which are adapted for mounting on simple face printed circuits which are much less expensive than double face circuits which often had to be used with previously known contactors.

According to the present invention there is provided an electrical push button contactor comprising, a base having an inner axial recess, a button telescopically mounted on said base and formed with an axially inwardly projecting guide post which is stepped down in diameter to provide two longitudinally spaced inwardly facing annular shoulders separated by a short intermediate post length portion which terminates in an axial post extension having a sliding fit in said inner recess of said base, spring means surrounding said extension and positioned between said inner recess of said base and the lower shoulder of said post for normally biasing said button away from said base, at least two spaced stationary contact members positioned within said base and having portions extending outwardly therefrom, and a movable contact member comprising a flexible, resilient, ring-shaped disc positioned on said intermediate post length for bridging said stationary contact members, whereupon further movement of said movable contact member in the same direction as causes said movable member to contact said stationary member tends to flex said movable contact member thereby providing a wiping action between said movable contact member and said stationary contact member, and further causes said flexed contact member to exert on each of said stationary contact members a substantially equal contact pressure even where said stationary contact members are of different heights relative to said base.

Preferably, a contactor as claimed in claim 1, in which the part forming the cap and push button includes an axial guide post and an aperture is provided in the base for the reception and guidance of the free end of the said post, in which the return spring is in the form of a helical spring mounted on the said post, and in which the movable contact is a small plate having a central hole loosely fitted on the said post so that the movable contact is connected in a floating manner to the push button and can be brought to bear in a balanced manner on the fixed contacts when the push button is in the operative position.

Preferably also, a contactor as claimed in the last two preceding paragraphs, in which the base carries three fixed contacts.

Good results are obtained with a ring of which the thickness is in the order of one hundredth of the diameter, for example, eight hundredths of a millimeter for a diameter of 7 mm.

An embodiment of the invention will now be described, by way of example, with reference to the accompanying drawings, in which.

Figure 6:
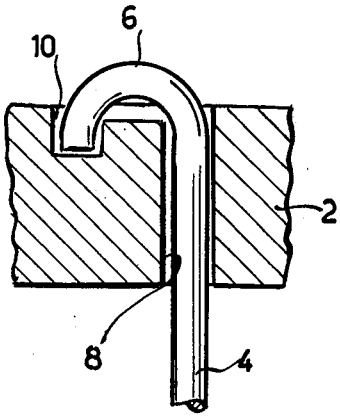
FIG. 6 is a fragmentary sectional view of the base of the contactor, showing the arrangement of the contacts.

A contactor according to the invention comprises a base 2 of electronically insulating plastic material. The base carries at least two fixed contacts which in accordance with the embodiment shown, are formed by cylindrical wires 4 (see FIG. 6) which pass through the base and are bent back on the upper face of the base in a half-loop 6 which forms the fixed contact on which a movable contact comes to bear so as to establish a bridge between the fixed contacts. The ends projecting below the base 2, i.e. the wires 4, constitute the output terminals of the contactor, and are provided for engaging in the holes in a printed circuit which has a plurality of identical contactors forming a keyboard.

Figure 3:
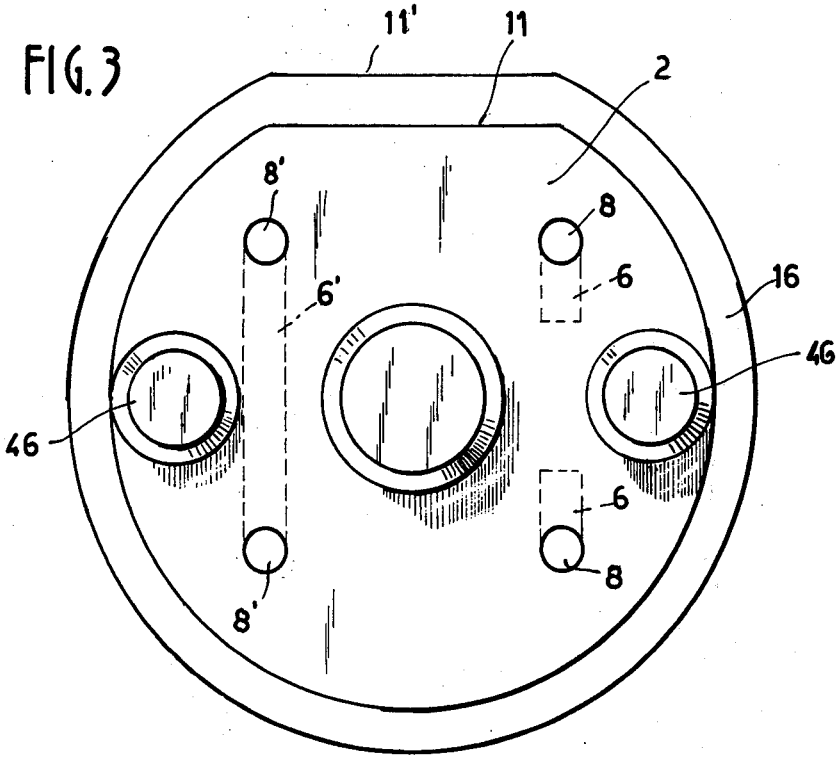
FIG. 3 is a plan view corresponding to FIG. 1 from below.
Figure 4:
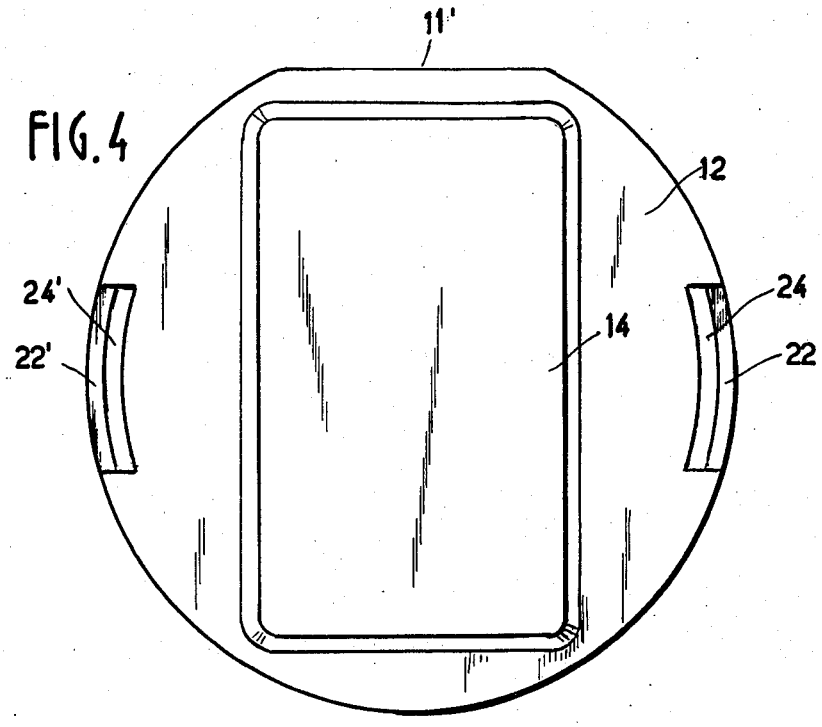
FIG. 4 is a plan view corresponding to FIG. 1 from above.
Figure 5:
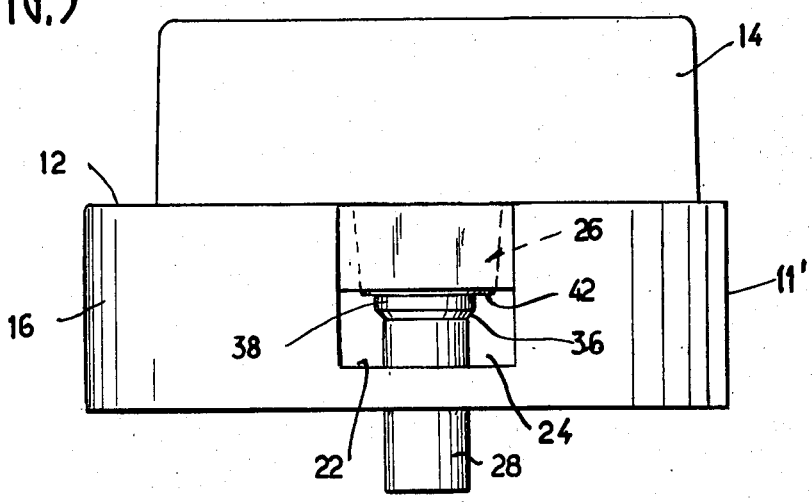
FIG. 5 is an elevation of the push button cap.

In the embodiment shown, the base has four holes 8 for reception of the contact wires. In two of the holes 8'—8' (FIG. 3), there can be fitted a single wire 4', bent in the form of a staple, to form, on the upper part of the base, a single fixed contact 6' provided with two output wires 4'. The contactor can thus comprise an inner bridge which constitutes a permanent connection between two points in the printed circuit on which the contactor is mounted. Such an arrangement can avoid use of double face printed circuits.

The contactor can thus comprise three fixed contacts 6—6 and 6' which will be connected when the movable contact engages the fixed contacts.

In the upper face of the base 2, recesses 9 receive the bent-back ends of the wires 4 so as to locate the contacts 6. Preferably, in the contact 4'-6'-4' with two outlets and bent to the form of a staple, the upper branch is generally of roof shape so as to ensure more of a point contact than a linear contact. The base 2 is preferably circular, and may have a flat portion 10 facilitating setting of the orientation of the contactor, and preventing pivoting of the cap, as will be seen later.

The base 2 is covered by an insulating cap 12 of which the push button 14 forms an integral part. The cap 12 is in the form of a cup and comprises a skirt 16 which fits and slides on the cylindrical exterior part 18 of the base 2. The skirt 16 also has a flat portion 10' corresponding to the flat portion 10, and this prevents the push button cap pivoting relative to the base.

As will be seen later, and as is conventional in a push button contactor, the button is urged to its raised (inoperative) position by a return spring. In the contactor according to the invention, the base 2 has stop means formed by two projecting teeth 20–20' which are abutted by the lower parts 22–22' of the skirt 16 of the cap 12. Windows (slots) 24–24' provided in the skirt 16 permit free passage of the teeth 20–20' when the cap slides on the base. The bottom of the skirt, especially the parts of the skirt corresponding to the parts 22–22', have a chamfer facilitating resilient ratchet engagement of the cap 12 on the base 2 during assembly.

The single moulded piece in the form of a cup forming the cap and the push button comprises, on the inside of the cup, an axial post 26 of which the end 28 engages in a blind hole 30 provided in the bottom of the base 2.

A return spring 32 fits around the end 28 of the post 26 and presses on the one hand against the bottom 34 of the base 2, and on the other hand against a shoulder 36 on the post 26–28.

On the intermediate part 38 of the intermediate post, there is fitted the movable contact which is preferably in the form of a thin metallic disc 40. The central aperture of the disc 40 has a diameter slightly greater than that of the intermediate part 38 of the post, so that the disc may float on the post. In the axial direction, the disc is located on the one hand by a shoulder 42 between the parts 26 and 38 of the axial post, and on the other hand by the upper convolution of the return spring 32.

Figure 1:
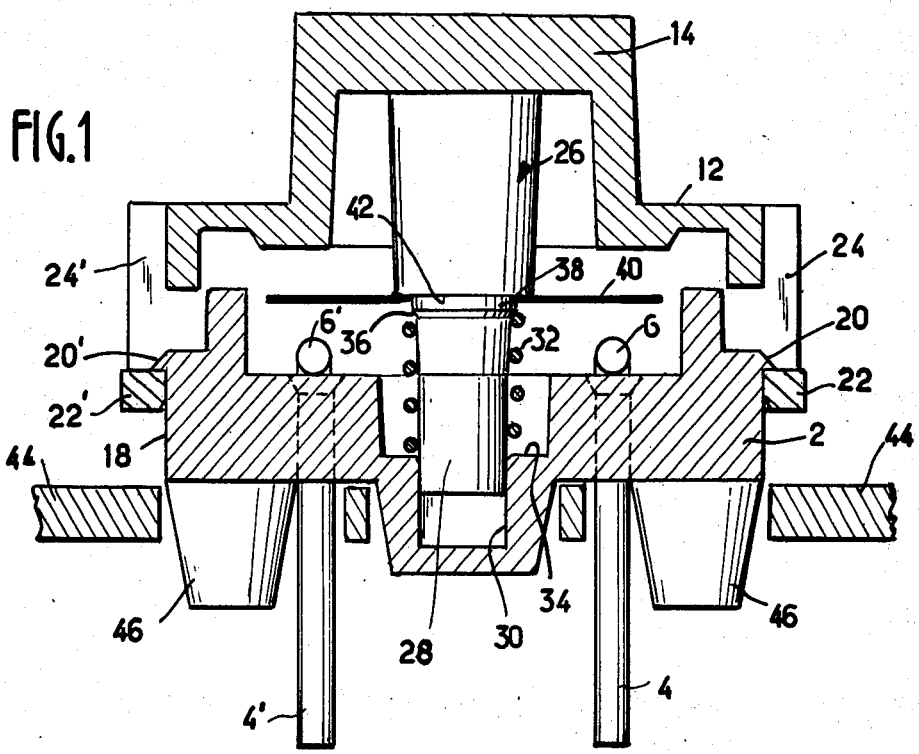
FIG. 1 is an axial sectional view of a contactor according to the invention is an inoperative condition.
Figure 2:
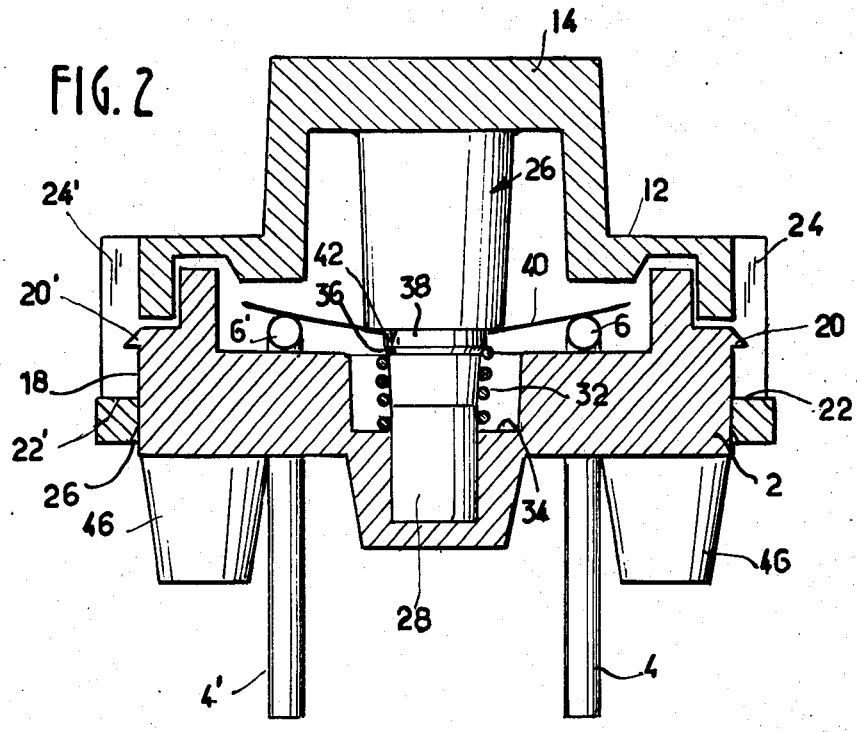
FIG. 2 is a sectional view corresponding to FIG. 1, but in the operative condition.

The inoperative condition of the contactor is shown in FIG. 1, and the operative condition is shown in FIG. 2.

In the latter position with the push button 14 being held depressed manually, the metallic disc 40 bears on the fixed contacts 6-6-6' so as to close one or more circuits connected to the terminals 4-4-4'-4'.

The depression of the push button is limited by the end of the post 28 abutting the bottom of the recess 30 in the base. In this depressed position, the centre of the disc 40 is pressed by the shoulder 42 of the post 26. The floating mounting of the disc 40 on the post permits the disc to engage the fixed contacts in a balanced manner.

In the inoperative condition, the uppermost convolution of the spring does not press on the disc 40 and does not thus impede its floating mounting.

According to a preferred embodiment of the invention, the disc 40 is very thin, for example, in the region of one hundredth of its diameter, and it is made of resilient metal. As a result of this arrangement, in the operation position shown in FIG. 2, the disc 40 flexes slightly to a dish shape, and its marginal portions effect a wiping action on the contacts 6–6' which produces a self-cleaning effect between the fixed contacts and the movable contact in each operation. The flexing of the disc 40 is limited to a predetermined amount due to the limitation of the depression of the push button by the abutment of the end 28 of the post against the bottom of the recess 30.

In the miniature contactor having an external diameter of about 11.5 mm, the disc forming the movable contact may have a diameter of about 7 mm, and a thickness of eight hundredths of a millimeter.

Assembly of the members forming a contactor according to the invention is extremely simple and quick, as it is sufficient to fit the disc 40 and the spring 32 to the post 26–28 of the cap and then to fit the cap on the base, previously provided with fixed contacts, until ratchet engagement of the teeth 20–20' of the base occurs beyond the parts 22–22' of the skirt of the cap. Such an assembly can be effected economically on an automatic machine.

The cylindrical wires serve as output terminals and fixed contacts and the disc forming the movable contact can be of metal plated with silver, tin or rhodium or any other similar protective material.

The contactors according to the invention can be fixed directly by their output wires on a printed circuit.

In the event that a large number of contacts have to be assembled to form a keyboard, it is more practicable to fix the contactors, grouped as a keyboard, on a suitably apertured plate 44 (FIG. 1). In this case there are provided in the moulding, below the base 2, wedges 46 of which the end is subsequently softened thermically in order to fix each contactor to its apertured plate. The apertured plate provided with its contactors can then be presented en bloc to the printed circuit to constitute the final keyboard, for example, on a miniature calculator.

Of course, the invention is not limited to the embodiment described and shown, it being open to numerous modifications available to the man of the art, according to the applications envisaged, and without departing from the spirit of the invention.

I claim:

1. An electrical push button contactor comprising:

(a) a base having an inner axial recess;

(b) a button telescopically mounted on said base and formed with an axially inwardly projecting guide post which is stepped down in diameter to provide two longitudinally spaced inwardly facing annular shoulders separated by a short intermediate post length portion which terminates in an axial post extension having a sliding fit in said inner recess of said base;

(c) spring means surrounding said extension and positioned between said inner recess of said base and the lower shoulder of said post for normally biasing said button away from said base;

(d) at least two spaced stationary contact members positioned within said base and having portions extending outwardly therefrom;

(e) a movable contact member comprising a flexible, resilient, ring-shaped disc positioned on said intermediate post length for bridging said stationary contact members; the inner diameter of said disc being greater than the diameter of said intermediate post length portion but smaller than the diameter of the upper annular shoulder and also smaller than the outer diameter of said spring means;

whereupon further movement of said movable contact member in the same direction as causes said movable member to contact said stationary members tends to flex said movable contact member thereby providing a wiping action between said movable contact member and said stationary contact members; and (f) abutment means for stopping said further movement of said movable contact member when the flexion thereof has attained a predetermined degree at which the movable contact member exerts on each of said stationary contact members a contact pressure at least equal to the requisite minimum contact pressure even where the effective contact areas of said stationary contact members lie at different heights relative to said base.

2. The electrical push button of claim 1, wherein said spaced stationary contact members comprise three stationary contact members disposed within a triangular pattern within said base.

3. The electrical push button of claim 1, in which the stationary contact members are constituted by cylindrical wires of which the heads are bent back on the base, said wires passing through the base, and their ends, projecting outside the base, forming the connecting terminals of the contactors.

4. The electrical push button of claim 1, in which one of the stationary contact members is formed by the intermediate branch of a cylindrical wire bent in the form of a staple, the two side wires of said staple forming two connecting terminals of said contactor.

5. The electrical push button of claim 1, in which the thickness of the disc is in the region of one hundredth of its diameter.

6. The electrical push button of claim 1, in which the base includes ratchet and stop means for the button, and in which said button is provided with co-operating ratchet and stop means.

7. The electrical push button of claim 1, in which the outer face of the base is provided with projecting lugs for mounting the contactor on an apertured mounting plate, said lugs consisting of a thermoplastic material.

8. The electrical push button of claim 1, in which the base and the button are substantially circular with a flat portion preventing rotation of the button relative to the base.

* * * * *